United States Patent [19]

Gronau

[11] 4,261,395

[45] Apr. 14, 1981

[54] WIND-UP HEAD

[75] Inventor: Kurt Gronau, Euskirchen, Fed. Rep. of Germany

[73] Assignee: B&G Fördertechnik GmbH, Euskirchen, Fed. Rep. of Germany

[21] Appl. No.: 29,734

[22] Filed: Apr. 13, 1979

[30] Foreign Application Priority Data

May 16, 1978 [DE] Fed. Rep. of Germany ..... 2821336

[51] Int. Cl.[3] ..... B21F 7/00

[52] U.S. Cl. ..... 140/102; 140/149; 83/909

[58] Field of Search ..... 140/1, 2, 102, 149, 140/115; 83/909; 130/1; 29/564.3

[56] References Cited

U.S. PATENT DOCUMENTS

| | | | |
|---|---|---|---|
| 1,243,353 | 10/1917 | Snedeker | 140/149 |
| 2,827,926 | 3/1958 | Seltzer | 140/115 |
| 3,059,670 | 10/1962 | Burford et al. | 140/149 |
| 3,513,522 | 5/1970 | Thomson | 83/909 |

*Primary Examiner*—Lowell A. Larson

*Attorney, Agent, or Firm*—Diller, Ramik & Wight

[57] ABSTRACT

A wind-up head which is in particular provided for unwiring bales in conjunction with a cutting apparatus, comprises substantially a cylindrical wire receiving portion which at its work end has at least one receiving slit for gripping the wire and is arranged between two wire guide slits. In order to permit that the wind-up head is able to grip and coil wire lengths without the aid of further apparatus and in particular is able to grip directly the wires still engaging a bale when using it for unwiring bales without the aid of a special lift-off apparatus, the wire receiving portion is formed as a hollow cylinder from the work end of which at least two helical slits start penetrating the cylinder wall. The hollow cylindrical wire receiving portion is surrounded at a distance by an external cylinder which has at least two helical slits likewise starting from its work end and having an opposite hand to the slits of the inner hollow cylinder. The two cylinders are rotatable relative to one another in both directions. The wire winds up on the interval cylinder so that it is pulled off the bale and a small tight wire coil results therefrom which is easy to collect and discard.

11 Claims, 5 Drawing Figures

WIND-UP HEAD

This invention relates to a wind-up head, in particular for unwiring bales in conjunction with a cutting apparatus, comprising a cylindrical wire receiving portion which has at its work end a receiving slit for gripping the wire and is arranged between two wire guide slits, as well as means for axially shifting the wound-up wire off the wire receiving portion.

A prior art wind-up head which is known from the U.S. Pat. No. 3,513,522 substantially comprises a rod of solid cross-section and has at its work end a slit extending parallel to the axis through the rod. The rod is guided axially shiftable along a plane extending parallel to the support surface of the bale above the bale to be unwired. When the wires surrounding the bale have been severed by means of the cutting apparatus, the wires severed and extending parallel are combined by a receiving apparatus following the cutting apparatus and lifted off the bale. Then the wind-up head is shifted in axial direction until it grips over the lifted off severed wires with its receiving slit. Then the wind-up head is rotated and winds up the wire ends until a tight wire coil has resulted. Then the wind-up head returns into its starting position and in doing so strips off the wound-up wire ends. Such an apparatus is relatively complicated, for it requires an additional means for combining the severed wire sections and for lifting them off the bale.

An object of this invention is to provide a wind-up head which without the aid of further devices is able to grip and wind up wire lengths and in particular for unwiring bales is able to grip the wires still engaging the bale directly without the aid of a separate lift-off device.

According to the invention, it is provided for that the wire receiving portion is a hollow cylinder, that the wire receiving opening provided at the work end of the wire receiving portion is defined by at least two helical slits penetrating the cylinder wall and starting from the work end of the hollow cylinder, that the hollow cylindrical wire receiving portion is surrounded at a distance by an external cylinder which has at least two helical slits likewise starting from its work end and extending at an opposite hand to the slits of the inner hollow cylinder, and that the two cylinders are rotatable relative to one another.

When using the wind-up head according to the invention in a bale unwiring apparatus, the wind-up head preferably is arranged in such a way that it is able to engage at the side of the bale opposite to the cutting apparatus. After the wire has been severed on the opposite side, either the wind-up head is moved against the bale or the bale is moved against the wind-up head in such a way that the face work end of the wind-up head directly engages the wire to be severed. When the two cylinders belonging to the wind-up head are rotated relative to one another, the wire winds up on the internal cylinder so that it is drawn off the bale and a small, tight wire coil results therefrom which is easy to be collected and discarded. For collecting the wire coils, a collecting container may be positioned underneath the wind-up head, in which container the coil is discarded from the wind-up head during a countersense relative rotation of the cylinders. The two cylinders rotatable relative to one another are preferably arranged axially parallel to one another so that the intermediate space between the two cylinders defining the receiving space for the wire coil has a constant cross-section throughout its length and opposes a jamming of the wire.

The external cylinder of the wind-up head preferably is stationary, while the internal cylinder is rotatable in both directions. With this structure, the internal cylinder grips the wire in its helical slits, draws it to the end of the slits into the cylinder and then winds it up on its external perimeter, while the slits of the external cylinder serve the purpose of passing the wire into the intermediate space between the two cylinders.

The internal cylinder preferably is mounted on the shaft of a motor, preferably an electric transmission motor having a slow output speed. However, for instance also a hydraulic motor may be provided. The motor is preferably designed in such a way that it is adjustable in such a way that its shaft upon coming to a stop assumes a predetermined position relative to the wire to be received. This brings about the advantage that the wire is received more reliably and in a simpler way by the slits of the internal cylinder. When the internal cylinder has two receiving slits, which is preferably the case, the motor is adjusted in such a way that the input ends of the slits are precisely positioned above the wire.

In order to insure an easier gripping of the wire by the internal cylinder, the work end of the internal cylinder may project a distance beyond the work end of the external cylinder.

The slits of the internal cylinder conveniently extend further rearwardly away from the work end than those of the external cylinder do, so that the wire is able to be satisfactorily drawn into the intermediate space between the two cylinders and is able to be reliably wound up.

The two slits provided in each cylinder may be inclined at an angle of about 30° to 50° relative to the cylinder axis and may flare toward the work ends of the cylinders. The enlargements of the slits in this context are to advantage formed unilaterally at the blunt sides opposing the points provided at the facial cylinder end. Thereby, the points passing the wire into the slits will be preserved, while by the flattened and enlarged opposite region a free space is obtained so that the cylinders are able to be better passed to the wire and accept it. The unilaterally formed slit enlargements preferably extend up to short of the facial points of the adjacent slit.

The internal cylinder is preferably arranged eccentrically relative to the external cylinder, it thereby being accomplished that a very tight coil results the dimensions of which are determined by the narrowest place of the intermediate space between the two cylinders.

The ejection of the wire coil normally is effected in that the internal cylinder is rotated in countersense so that the coil supporting itself on the internal diameter of the external surface is screwed out of the intermediate space. Since the wind-up head is to be used for wires of a wide variety of types, however, it may happen for instance with such wires which are plastically easily deformable and have no sufficient rigidity that the wire stays on the internal cylinder. For aiding the ejection process, therefore in the free cross-section between the external surface of the internal cylinder and the internal surface of the external cylinder an additional ejector may be arranged. Said ejector may comprise an annulus filling the free cross-section between the two cylinders, said annulus being shiftable relative to the cylinders in axial direction.

The wind-up head may be movable in transverse direction of the wires to be received and shiftable in axial direction so that the relatively heavy bales need not be shifted during unwiring. For locating the wires, the wind-up head may be combined with an automatically operating wire detector which interrupts the transverse shifting as soon as it is located above the wire and which initiates the winding up operation.

The invention is illustrated by way of example in the drawings and described hereinafter in detail in referring to the drawings. Therein:

Figure 1:
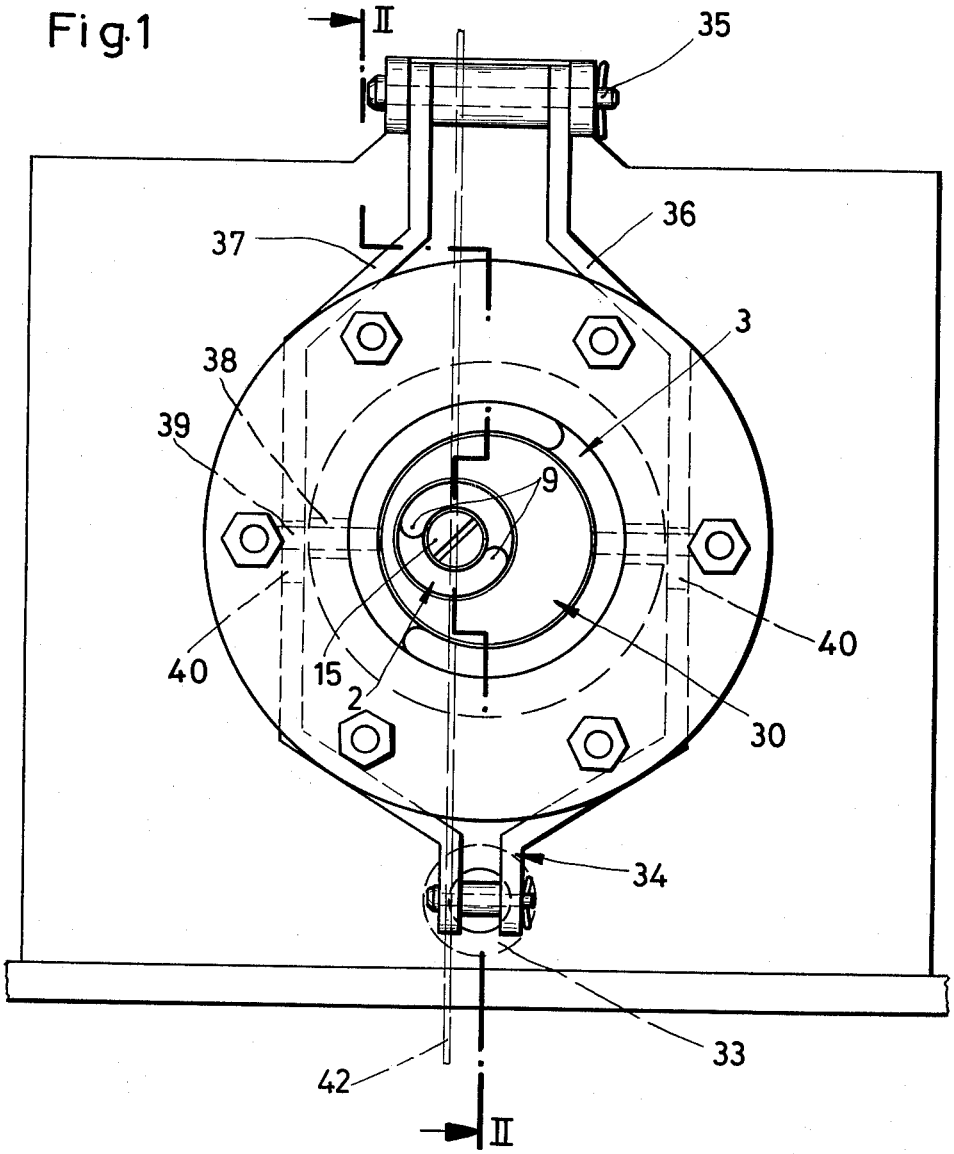
FIG. 1 is an elevational view of the wind-up head in direction of its work end.
Figure 2:
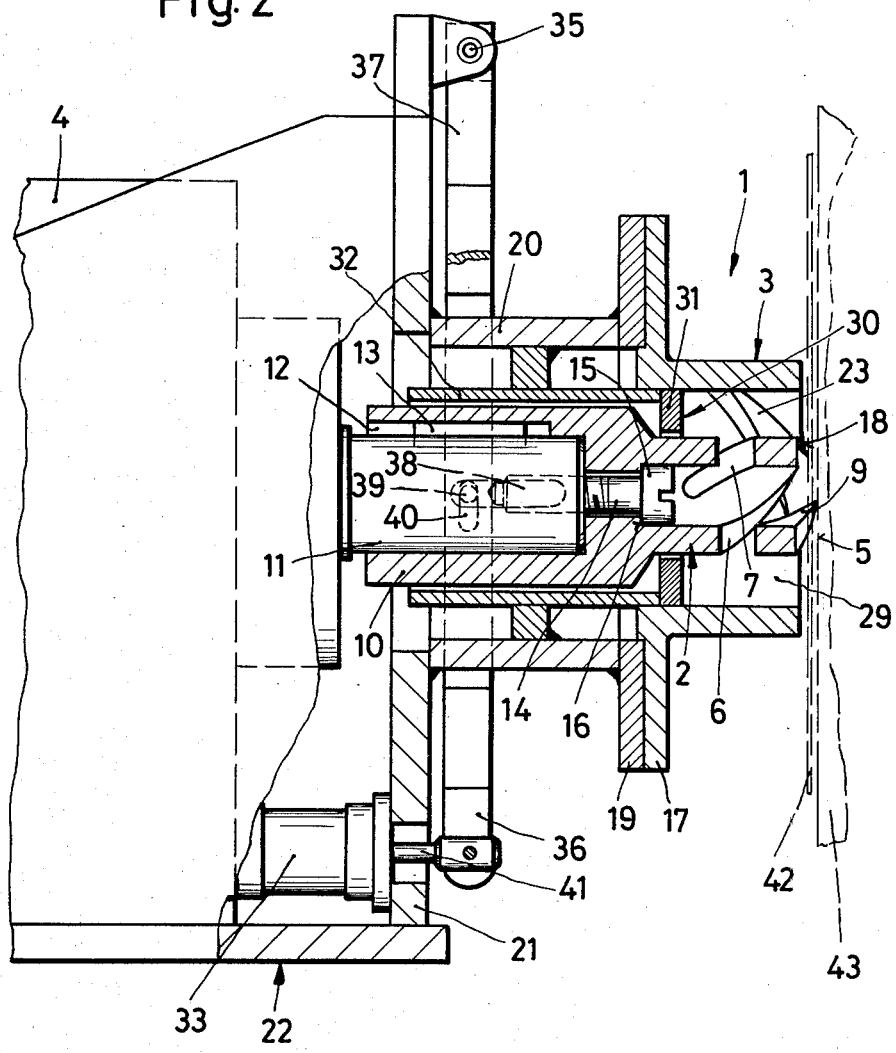
FIG. 2 is a sectional view taken along line II—II of FIG. 1.
Figure 3:
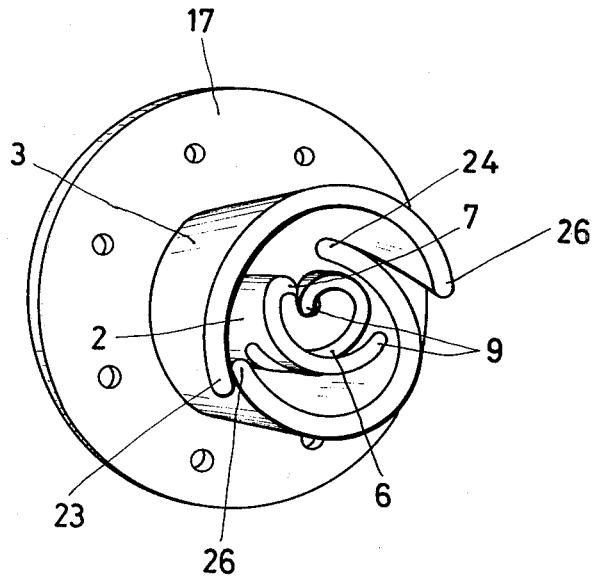
FIG. 3 is an elevational view of the front portion of the wind-up head in a perspective illustration.

As illustrated in the drawings, the wind-up head 1 substantially comprises a tubular internal cylinder 2, an external cylinder 3 surrounding same at a distance, as well as an electric transmission motor 4 for driving the internal cylinder 2.

The tubular internal cylinder 2 is provided with two helical continuous slits formed into the cylinder wall and starting from its work end 5, said slits being arranged offset relative to one another by 180°.

Figure 4:
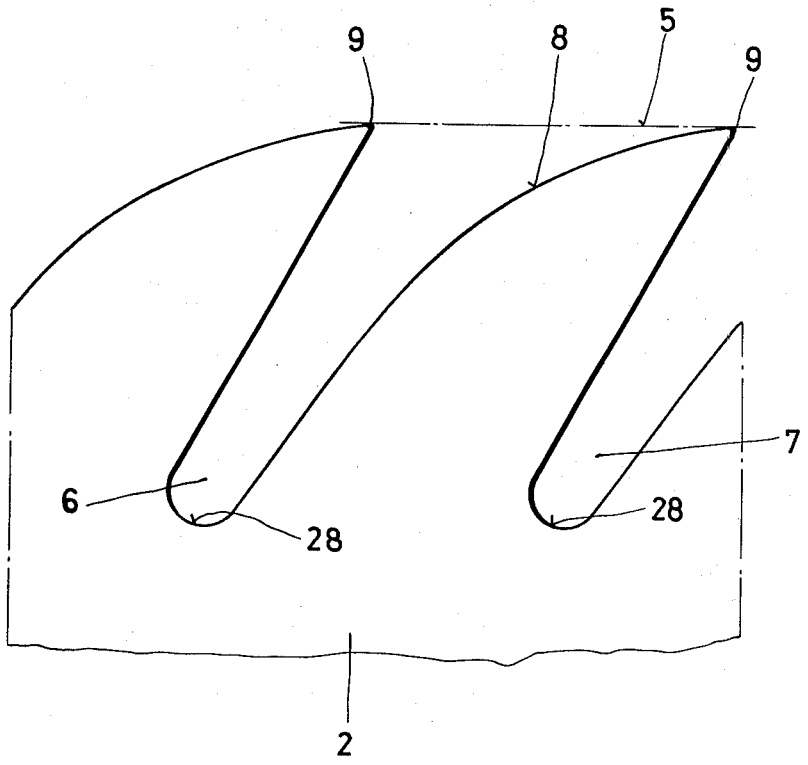
FIG. 4 is a development of the internal cylinder.
Figure 5:
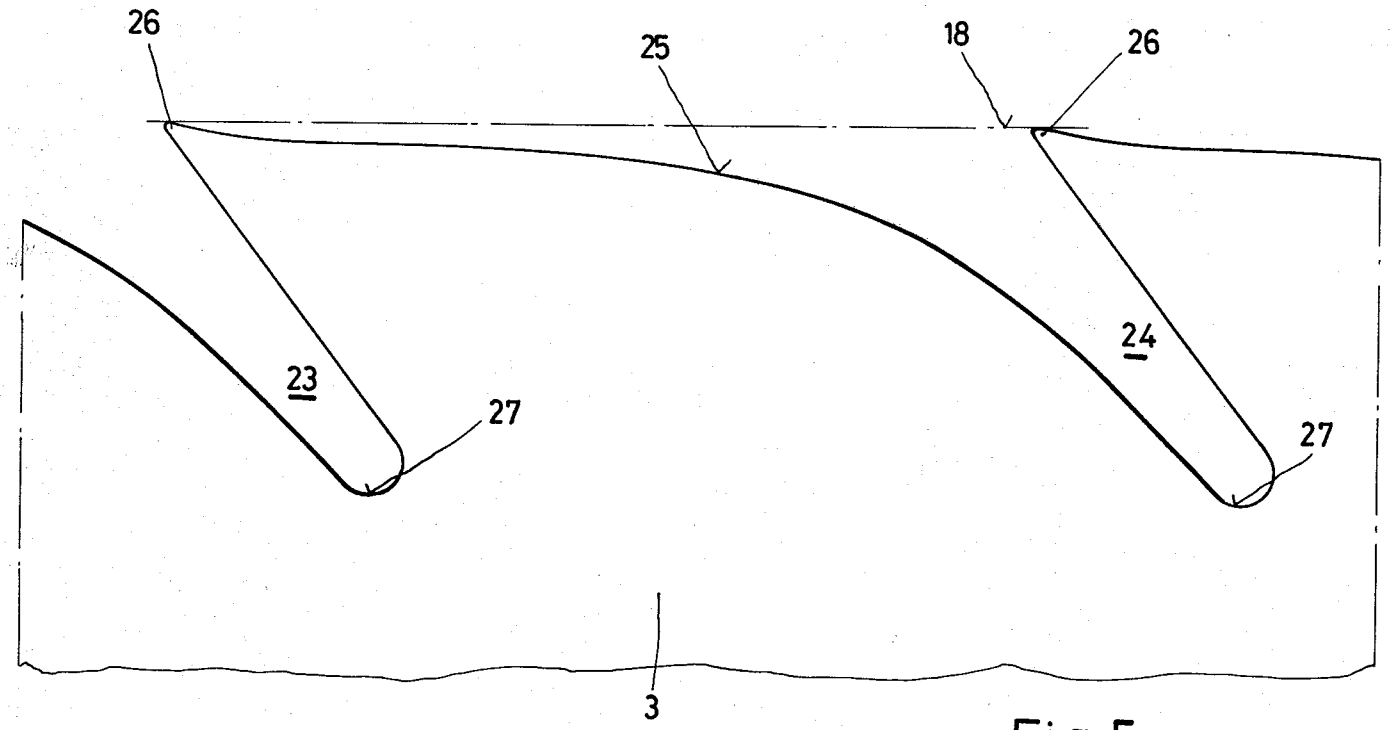
FIG. 5 is a development of the external cylinder.

As will be noted from the development of the internal cylinder 2 illustrated in FIG. 4, the slits 6 and 7 are arranged inclined by about 30° to 40° relative to the cylinder axis and are provided at the face end 5 with unilateral enlargements 8. The enlargements 8 of the slits are formed at the blunt slit surface which oppose the points 9 provided at the facial work end 5 and extend to the point of the adjacent slit. At the face end 5 of the internal cylinder, the slits consequently extend through an arc of approximately 180°, so that the face end is merely defined by the two points 9.

The portion of the internal cylinder 2 opposite to the work end 5 is defined as a push-on sleeve 10 which positively mechanically extends over the drive shaft 11 of the motor 4. In direction of rotation, the sleeve 10 is caused to concurrently move by a spring 13 located on the motor shaft 11 and engaging in a groove 12, and in axial direction, the sleeve is retained by a screw 14 screwed into the face of the shaft 11, the head 15 of said screw engaging an internal shoulder 16 of the internal bore of the cylinder 2.

The external cylinder 3 surrounding the internal cylinder at a distance is arranged stationarily. It is secured via a flange 17 which is arranged at the end of the external cylinder 3 remote from the work end 18 to a retaining flange 19 which is connected via a support sleeve 20 surrounding the motor shaft 11 at a distance to the face plate 21 of a frame 22 at which the motor 4 is also mounted. The axes of the internal cylinder 2 and the external cylinder 3 are parallel spaced from one another in a horizontal plane so that the internal cylinder 2 is arranged eccentrically relative to the external cylinder 3.

The external cylinder 3 is provided just like the internal cylinder 2 with two helical slits 23 and 24 starting from its work end 18, said slits being arranged at an opposite hand to the slits 6 and 7 of the internal cylinder 2. The slits 23 and 24 are inclined by about 40° to 45° relative to the cylinder axis and have unilateral enlargements 25 at the work end, said enlargements being opposite to the points 26 and extending to the respective point of the adjacent slit.

The ends 27 of the slits 23 and 24 opposite to the work end 18 terminate in a plane which is closer to the work end than that plane which passes through the ends 28 of the slits 6 and 7 of the internal cylinder 2.

The work end 5 of the internal cylinder 2 projects a distance beyond the work end 18 of the external cylinder 3 so that the points 9 of the internal cylinder grip the wire to be wound up first and draw it into the intermediate space 29 between the two cylinders. The ejection of the wound-up wire is effected in that the internal cylinder 2 is rotated in opposite direction, thereby the resulting wire coil virtually being screwed out off the intermediate space 29. For supporting ejection, an ejector 30 is provided in the intermediate space 29. Said ejector comprises an axially shiftable annulus 31 which fills the entire cross-section of the intermediate space 29 between the external surface of the internal cylinder 2 and the internal surface of the external cylinder 3 and is able to be shifted up to the work end 5 of the internal cylinder 2. The annulus 31 is positioned at a tube 32 guided axially shiftable in the support sleeve 20, said tube being able to be shifted by means of a power operating means, for instance a pneumatic or hydraulic cylinder 33. The cylinder 33 which is secured to the face plate 21 of the frame 22 transmits a force to a clevis 34 which is connected via a pivot 35 to the upper end of the face plate 21 and the limbs 36 and 37 of which encompass the support sleeve. At the guide tube 32 which carries the ejector 30, two lateral pins 39 passing through longitudinal slots 38 provided in the support sleeve 20 are secured which pass through elongate holes 40 provided in the limbs 36 and 37 of the transmission clevis 38. By shifting the stroke rod 41 of the cylinder 33, the clevis 34 is pivoted about its pivot 35, thereby the tube 32 provided with the ejector 30 being forced to concurrently move in axial direction.

The operation of the wind-up head is thus:

Initially, the entire wind-up head 1 is shifted transverse of the wire 42 to be severed and strung around the bale 43. By means of a wire detector, for instance an inductively operating proximity switch, the wire is located and the wind-up head is arrested, as soon as the work end 5 of the internal cylinder 2 is positioned above the wire. The motor 4 is adjusted in such a way that the points 9 of the internal cylinder opposing each other are positioned at both sides of the wire 42. Then the entire wind-up head 1 is moved against the bale 43, the points 9 of the internal cylinders being impressed a distance into the bale 43. Then the internal cylinder 2 is started to rotate, the points 9 gripping the wire 42 and drawing it via the slits 6 and 7 into the free space 29 between the external cylinder 3 and the internal cylinder 2. The slits 23 and 24 of the external cylinder serve to guide the wire lengths moving into the intermediate space 29.

When the wire length 42 has been completely wound up, the cylinder 2 is rotated in opposite direction, thereby the coil obtained being screwed out of the wind-up head. Before, either the wind-up head 1 is retracted from the bale 43 or the bale 43 is transported on so that the wire coil is able to drop from the wind-up head 1 into a collecting container not illustrated in the drawings. The ejection process may be further supported by operating the power cylinder 33, thereby the ejector being urged in direction of the work end and possibly pushing the coil out of the intermediate space 29.

What is claimed is:

1. A wind-up head, in particular for unwiring bales in conjunction with a cutting apparatus, comprising a cylindrical wire receiving portion which has at its work end a receiving slit for gripping the wire and is arranged between two wire guide slits, as well as means for axially shifting the wound-up wire off the wire receiving portion, the improvement being that the wire receiving portion is a hollow cylinder, that the wire receiving opening provided at the work end of the wire receiving portion is defined by at least two helical slits penetrating the cylinder wall and starting from the work end of the hollow cylinder, that the hollow cylindrical wire receiving portion surrounded at a distance by an external cylinder which has at least two helical slits likewise starting from its work end and extending at an opposite hand to the slits of the inner hollow cylinder, and that the two cylinders are rotatable relative to one another.

2. A wind-up head as set forth in claim 1, wherein the cylinders are arranged axially parallel to one another.

3. A wind-up head as set forth in claim 1 wherein the external cylinder is stationary, while the internal cylinder is rotatable in both directions.

4. A wind-up head as set forth in claim 3, wherein the internal cylinder is drivable by a motor and wherein the motor is adjustable such that its shaft during standstill assumes a predetermined position relative to the wire to be received.

5. A wind-up head as set forth in claim 1, wherein the work end of the internal cylinder projects a distance beyond the work end of the external cylinder.

6. A wind-up head as set forth in claim 1, wherein the slits of the internal cylinder extend further rearwardly from the work end than those of the external cylinder do.

7. A wind-up head as set forth in claim 1, wherein each cylinder has two slits which are inclined at an angle of about 30° to 50° relative to the respective cylinder axis and wherein the slits flare toward the work ends of the cylinders.

8. A wind-up head as set forth in claim 7, wherein the slits of each cylinder have enlargements, each enlargement having a blunt side, a wall portion between adjacent slits defining a point, the enlargements of the slits are formed unilaterally at the blunt sides which oppose the points provided at the work end and extend short of the points of the adjacent slit.

9. A wind-up head as set forth in claim 8, wherein the internal cylinder is arranged eccentrically in the external cylinder.

10. A wind-up head as set forth in claim 9, wherein an ejector is arranged in the free cross-section between the external surface of the internal cylinder and the internal surface of the external cylinder.

11. A wind-up head as set forth in claim 10, wherein the ejector is an annulus filling the free cross-section between the two cylinders, said annulus being shiftable relative to the cylinders in axial direction.

* * * * *